US006450769B2

(12) United States Patent
Szwedowicz

(10) Patent No.: US 6,450,769 B2
(45) Date of Patent: Sep. 17, 2002

(54) BLADE ASSEMBLY WITH DAMPING ELEMENTS

(75) Inventor: Jaroslaw Szwedowicz, Nussbaumen (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/800,777

(22) Filed: Mar. 8, 2001

(30) Foreign Application Priority Data

Mar. 22, 2000 (DE) ..... 100 14 198

(51) Int. Cl.[7] ..... F01D 5/26

(52) U.S. Cl. ..... 416/190; 416/193 A; 416/239; 416/500

(58) Field of Search ..... 415/119; 416/239, 416/500, 190, 193 A

(56) References Cited

U.S. PATENT DOCUMENTS

| | | | | |
|---|---|---|---|---|
| 3,666,376 A | | 5/1972 | Damlis | |
| 4,182,598 A | | 1/1980 | Nelson | |
| 4,872,812 A | * | 10/1989 | Hendley et al. | 416/190 |
| 4,936,749 A | * | 6/1990 | Arrao et al. | 416/193 A |
| 5,156,528 A | | 10/1992 | Bobo | |
| 5,478,207 A | * | 12/1995 | Stec | 416/219 R |
| 6,042,336 A | * | 3/2000 | Bulgrin et al. | 416/145 |

FOREIGN PATENT DOCUMENTS

EP 0374079 A1 6/1990

* cited by examiner

*Primary Examiner*—Edward K. Look
*Assistant Examiner*—Ninh Nguyen
(74) *Attorney, Agent, or Firm*—Burns, Doane, Swecker & Mathis, L.L.P.

(57) ABSTRACT

The present invention relates to a blade assembly with damping elements, which comprises a rotor (5) and blades (6) which are installed on the circumference of the rotor and have a blade platform (7), shank (14) and root (8). A damping element (9) is arranged between respectively adjacent blades (6), said damping element (9) being frictionally connected on rotation of the rotor (5), to at least a first region (1, 2) of a first of the respectively adjacent blades (6), and to a second region (3) of a second of the respectively adjacent blades (6). The blade assembly is characterized by the fact that the damping element (9) is configured and arranged between the first and second blades in such a way that the first region (1, 2) and the second region (3) are located at positions which are significantly spaced apart from one another in the radial direction.

This blade assembly provides efficient oscillation damping even in the case of small relative movements between adjacent blades.

10 Claims, 2 Drawing Sheets

BLADE ASSEMBLY WITH DAMPING ELEMENTS

BLADE ASSEMBLY WITH DAMPING ELEMENTS

The present invention relates to a blade assembly with damping elements. The blade assembly includes a rotor and blades which are installed on the circumference of the rotor, extending in the radial direction and each having a blade platform, shank and a root. Arranged at least between a number of respectively adjacent blades is a damping element which, on rotation of the rotor, is frictionally connected to at least a first region of a first of the respectively adjacent blades, and to a second region of a second of the respectively adjacent blades.

Such blade assemblies are used, in particular, in turbo-engines such as gas turbines. The individual blades are composed of the blade element, the blade platform, the shank and the root, which is inserted into corresponding recesses on the circumference of the rotor. When the blade assembly is operating, undesired oscillations occur owing to various excitation mechanisms, and said oscillations can lead to premature material fatigue, and thus to a shortened service life of the blade assembly. The present invention relates to a blade assembly with damping elements which reduce these oscillations.

Damping elements which act between the individual blades have been used to reduce the oscillations of the blade assembly. These damping elements are generally loose elements which in the state of rest come to bear initially between the blade shanks on the rotor, and are pressed in the radial direction against the blade platforms of adjacent blades when the rotor is operating, owing to the centrifugal force which acts. As a result, the kinetic energy of a relative movement between the blades which is brought about by oscillations can be converted into frictional energy between the respective blade platforms and the blade element which is connected in a frictionally locking fashion. This damps the oscillations and leads to reduced oscillation loading of the blade assembly.

Such a blade assembly with damping elements is described, for example, in U.S. Pat. No. 5,156,528. In this arrangement, the edge regions of adjacent blade platforms form a recess which tapers in the radial direction and into which the damping element is pressed by the centrifugal force. The geometric shape of the damping element is matched to the shape of this recess in such a way that when the blade assembly is operating it is connected into this recess in a frictionally locking fashion. The smallest distance between the adjacent blade platforms is smaller here than the dimensions of the damping elements so that the latter cannot become detached from the blade assembly. When there is a relative movement between the adjacent blades, the movement energy is converted into frictional energy occurring at the faces which make contact with the damping element.

In addition to the shape of the damping element, which is triangular in cross section according to the illustration in this publication, other geometric shapes with which frictional engagement can be made with adjacent blade platforms are also known. However, a disadvantage of this system is that only certain higher oscillation modes of the blade assembly are converted into frictional energy with a sufficient degree of effectiveness.

A blade assembly is generally composed of 30 to 200 blades. It can be excited in a plurality of oscillation modes. For example, in the case when there are N blades, N/2+1 different natural frequencies or modes are produced in the circumferential direction of the rotor. The oscillation difference between adjacent blades is greater at higher oscillation modes. For example, in low oscillation modes only very low relative movements occur between adjacent blades, while in high oscillation modes the relative movements become very large. When oscillations are damped by converting the vibration energy into friction, it is advantageous if the relative movement between the faces which are in frictional contact with one another is as great as possible. The above-mentioned technology of the damping elements which act between two adjacent blades is therefore effective only if the oscillation difference between adjacent blades is large. For this reason, the systems which are known from the prior art in this context can be used advantageously only for high oscillation modes. However, the resonances of rotating turbine blades which occur in practice are generally in the region of the lowest oscillation modes, so that the above damping elements are not sufficiently effective in this case.

SUMMARY OF THE INVENTION

In view of the above disadvantages of prior art systems, the present invention provides a blade assembly with damping elements in which the damping elements act between adjacent blades and also bring about sufficient damping even in low oscillation modes.

The blade assembly according to an embodiment of the invention has a rotor and blades which are installed on the circumference of the rotor and extend in the radial direction. Each blade is provided with a blade platform, a shank and a root. A damping element is arranged at least between a number of respectively adjacent blades, the damping element being frictionally connected, during rotation of the rotor, to at least a first region of a first of the respectively adjacent blades and a second region of a second of the respectively adjacent blades. The blade assembly includes the damping element configured and arranged between the first and second blades in such a way that the first region and the second region are located at positions which are significantly spaced apart from one another in the radial direction.

According to the invention, it has been recognized in this context that the relative movement of the faces of the damping element and of the respective blades which are in frictional contact with one another can be increased in low oscillation modes by spacing the contact faces, contact lines or contact points with the respectively adjacent blades farther apart in the radial direction. As a result of this radial distance the relative movements in low oscillation modes are increased, with the result that greater energy dissipation and thus better and more effective oscillation damping can be achieved. This technology is very advantageous in particular in the case of small relative movements between adjacent blades and in low oscillation modes, such as frequently occur. However, this technology can of course also be used for satisfactorily damping relatively large relative movements or relatively high oscillation modes.

The first and second regions are to be understood here as faces, lines or points, because the type of contact between the damping element and the blades depends on the shape of the surface of the respective contacting elements and on the operating state of the arrangement, i.e. on the rotational speed, temperature, wear and deposits. The present damping element is formed from a rigid body which is pressed against the first and second regions as a result of the centrifugal forces acting during rotation. When the damping body is pressed against regions of the adjacent blades, a portion of the energy of a vibrational movement is then converted into frictional work at the damping element.

In order to achieve an optimum damping effect, and effective dissipation of the vibration energy of low oscillation modes, the first and second regions must be spaced as far apart from one another as possible in the radial direction. The spacing in the radial direction can be preferably at least a third of the distance from the upper side of a blade platform to the surface of the circumference of the rotor. This intermediate space is taken up by the thickness of the blade platform and an upper region of the root that forms the shank. The lower region of the root is inserted in the holder or depression on the circumference of the rotor. An excessively small distance between the first and second regions leads to a situation in which the vibration energy in low oscillation modes cannot be converted into frictional energy to a sufficient degree.

Projections are provided on the blades to prevent the damping element from becoming detached while the rotor of the blade assembly is rotating. The blade platform itself can perform this function, but it is also possible to provide a separate projection on the blade in order to prevent the damping element from becoming displaced in the radial direction. Furthermore, in terms of its dimensions, the damping element should be configured in such a way that it is pressed against the adjacent blades only in the desired position when the blade assembly is operating. To this end, the damping element preferably has, in the radial plane, an elongate shape in cross section with a length which is greater than the distance between adjacent roots in the circumferential direction of the rotor. As a result of this, the damping element can be inserted between the blades in such a way that at one end it bears against the underside of the platform of the one blade, while the other end of the damping element presses against the root of the other adjacent blade at a significantly different radial position. The shape or configuration of the damping elements in the axial direction, that is to say in the direction parallel to the axis of the rotor, can be either linear or curved. This applies to all the damping elements which can be used in the arrangement according to the invention. In the present application, radial position is understood to mean the distance between a point and the axis of rotation in a radial plane. A radial plane constitutes a plane perpendicular with respect to the axis of rotation.

The precise shape of the damping elements depends on the shape, the dimensions and the distances between the individual blades of the blade assembly. The person skilled in the art will recognize that a variety of suitable shapes of the damping elements will fulfill the requirements of the invention. A number of basic shapes for suitable damping elements are presented in the exemplary embodiments given below.

The damping elements can be used particularly advantageously if their center of gravity is located near to the first or second region. The asymmetry of the damping element makes it possible to ensure that the vibration energy in the case of a relative movement between adjacent blades is converted into frictional energy in each case only at that region of contact with the damping element which is further away from the center of gravity of the damping element than the other contact region. As a result of the center of gravity of the damping element being selected to be as close as possible to one of these contact regions, there is no frictional movement, or only a very small frictional movement, at this region. This leads to an increase in the effectiveness of the conversion of energy.

In a further advantageous embodiment, the damping element has a region which is widened at one end and which, when the rotor operates, is pressed between the two platforms and thus acts as a damping element. The dimensions of this widened region and the shape of the edge regions of the platforms should be suitably matched to one another to enhance the damping action at this region. The damping element according to the invention has an extension which starts from this widened region and which extends to a region of the root which is significantly spaced apart from the platforms in the radial direction. The distribution of the center of gravity in the damping element is selected here such that the end of the extension is pressed against the root when the rotor is operating. In this embodiment, the damping properties are a result of friction between contacting surfaces that are not spaced from each other by a significant radial distance as well as contacting surfaces that are spaced from each other by a significant radial distance.

Depressions or grooves into which the damping element can be inserted or in which it engages during rotational operation and which prevent movement of the damping element in the axial direction are preferably provided on the first and/or second regions of the roots and/or blade platforms. For an optimum effect of the damping element, the first and second regions should be spaced as far apart as possible in the radial direction. Maximum spacing is achieved by the first region bearing against, or just below the platform of the first blade and just above the rotor surface on the shank of the second blade. The damping element can extend in the radial direction diagonally across the intermediate space between adjacent roots. The best damping effect can be achieved by arranging damping elements between all of the adjacent blades of the blade assembly. The mass, distribution of center of gravity, shape and material of the damping elements are selected in accordance with the desired damping properties and the properties of the rotor and the number of blades.

DESCRIPTION OF THE DRAWINGS

The invention is explained in more detail below by means of exemplary embodiments in conjunction with the drawings without restricting the general idea of the invention. In the drawings.

DESCRIPTION OF THE PREFERRED EMBODIMENTS

Figures 1A, 1B:
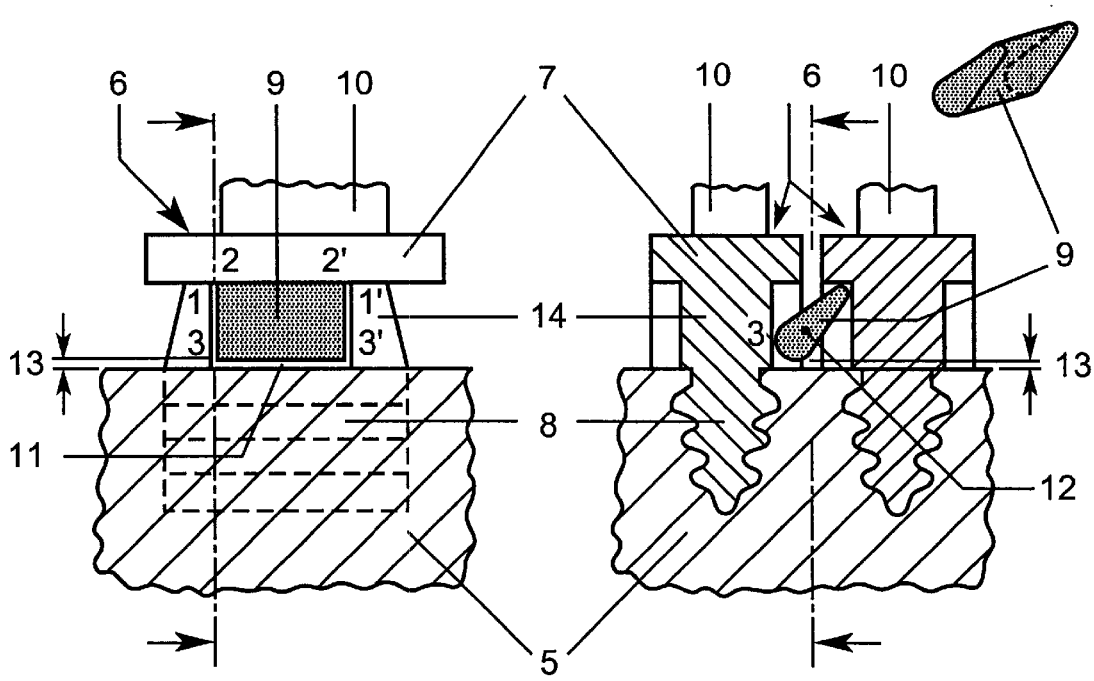
FIGS. 1A and 1B show a blade assembly according to a first embodiment of the invention in two cross-sectional views.

FIGS. 1A and 1B show a detail of a first example of an embodiment of the blade assembly according to the invention. A section through the blade assembly parallel to the axis of rotation is shown in FIG. 1A. The sectional plane includes the axis of rotation. In this partial view, it is possible to see the rotor 5 into which the root 8 of a blade is installed. The shank 14 and the blade platform 7 extend between the blade element 10 (illustrated only schematically) and the rotor 5. The same arrangement is illustrated in FIG. 1B in a section perpendicular to the axis of rotation, that is to say in a radial plane. A detail from the rotor 5 with two inserted blades 6, with the blade platforms 7 and the shanks 14 protruding out of the rotor can also be seen here.

In this example, a damping element 9 is arranged between the adjacent blades and is represented again in an enlarged perspective view in FIG. 1B. This damping element has, in the radial plane, an elongate, club-like shape so that its center of gravity 12 is displaced markedly toward one end. The arrangement of this damping element 9 when the blade assembly is operating and the rotor is rotating, is illustrated in FIG. 1B. The centrifugal force acting on the center of gravity 12 in the radial direction, presses the damping element 9 with the orientation shown against the adjacent blades 6. One end of the damping element is pressed against the contact regions 1 and 2 of the shank or blade platform of the right-hand blade, while the other end bears against the contact region 3 of the left-hand blade.

These contact regions may be, depending on the shape of the surface of the damping element 9, planes, points or lines. In the embodiment shown in FIG. 1B there is linear contact between the damping element and the contact regions on the adjacent blades. In FIG. 1A this linear contact is indicated by the connecting lines between the points 1, 2 and 3, and the points 1', 2' and 3'. This partial view also shows a groove 11 on the shank 14, in which groove 11 the damping element is arranged, as a result of which axial movements of the damping element are prevented.

The damping element 9 is configured in the present example in such a way that when the rotor is operating it can bear against the contact regions 1, 2 and 3 only in the position shown. In the state of rest, the damping element initially bears with the widened region against the rotor 5, and during a rotational movement it is forced into the position illustrated by the centrifugal force. For an optimum effect of the damping element in terms of the present invention, the dimensions of the damping element are selected in such a way that the remaining distance 13 from the rotor surface is as small as possible. In this way, the desired position of the damping element is reliably ensured when the rotor is operating.

When the rotor operates, frictional and reactive forces act on the regions 1, 2 and 3. The magnitude of these forces depends on the mass, the dimensions and the radial position of the damping element and on the rotational speed of the rotor. In the present case, in which the center of gravity of the damping element is located near to the contact region 3, the reactive force acting there is at a maximum, with the result that hardly any relative movement takes place between the damping element 9 and the shank 14 at this region 3. Given a vibrational movement between the two blades illustrated, the vibration energy is converted into friction at the corresponding contact regions 1 and 2.

In the present example, the junction between the shank 14 and blade platform 7 can also be embodied in a rounded fashion so that the damping element 9 can bear in a positively locking fashion against these regions.

Figures 2A, 2B:
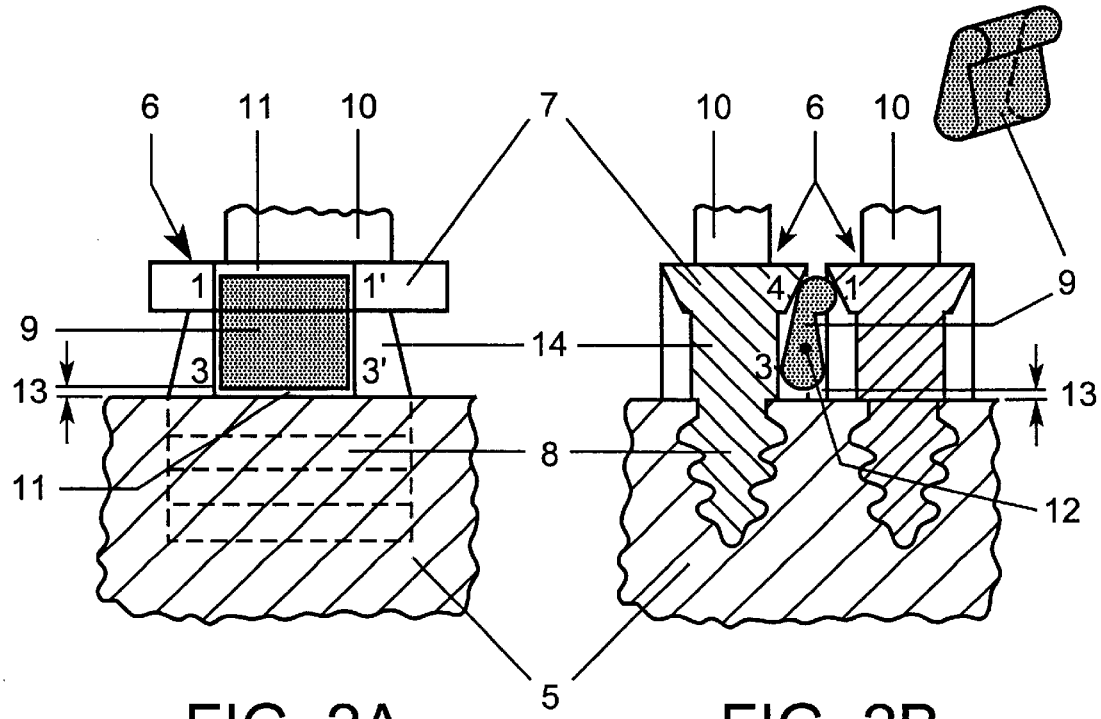
FIGS. 2A and 2B show a blade assembly according to a second embodiment of the invention in two cross-sectional views.

FIGS. 2A and 2B show a further exemplary embodiment of the blade assembly according to the invention. In these illustrations, the same views are shown as in the blade assembly in FIGS. 1A and 1B.

In this example, the damping element 9 is embodied with a widened region on one side, which region is pressed, when the rotor is operating, into a recess formed by the blade platforms 7 which are spaced apart. As shown in FIG. 2B, contact with the left-hand blade platform takes place at region 4 in addition to contact with the right-hand platform at region 1. This achieves at least the effect of the damping elements which are known from the prior art and which act on the blade platforms in a similar fashion. However, the present damping element has additional frictional contacting surfaces other than the widened region which engages between the two blade elements. The damping element has an elongate shape, or extension, in the radial plane, with a lower region being in contact with the left-hand shank in the region 3. In order to permit this contact with the region 3, the center of gravity 12 of the damping element 9 is located in the circumferential direction between the contact point 2 and the contact point 3 so that the damping element is thrust against the left-hand shank by the centrifugal force in the way illustrated.

The geometric shape of the damping element 9 used in this exemplary embodiment is illustrated in an enlarged perspective view at the top right of FIG. 2B. The recognizable asymmetry is desirable in this case in order to achieve the frictional locking with the illustrated contact points or contact faces 1, 3 and 4 when the centrifugal force acts. In this case too, the damping element 9 is dimensioned in such a way that it has only a small spacing 13 from the rotor 5. In the present case, this small spacing permits a large spacing—in the radial direction—between the contact region 3 and the contact region 1. This significant spacing is advantageous for achieving the effect according to the invention.

The way in which the damping element 9 acts on the two adjacent platforms 7 via the contact faces 1 and 4 can also be achieved by a different refinement of the edge regions of the platforms or of the upper end of the damping element 9. In this embodiment the extending of the damping element toward the rotor is important in achieving the desired frictionally locking contact with the contact face 3 during operation.

In the embodiment shown in FIGS. 2A and 2B, the oscillation of the blade assembly is damped simultaneously at all three regions 1, 3 and 4. In order to prevent an axial movement of the damping element, a groove 11 is provided in the blade platform 7, as is indicated in FIG. 2A.

Figure 3A:
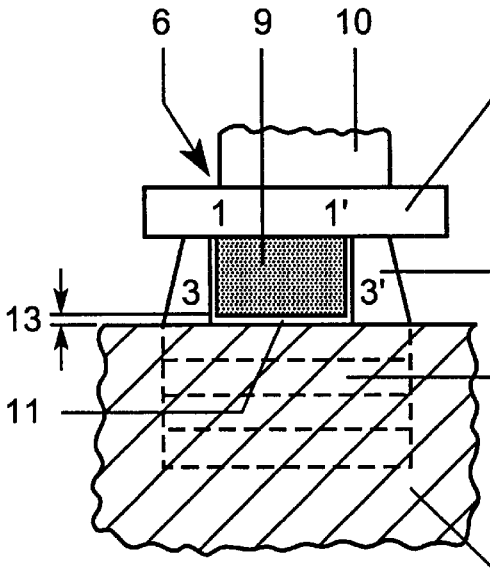
FIGS. 3A and 3B show a blade assembly according to a third embodiment of the invention in two cross-sectional views.
Figure 3B:
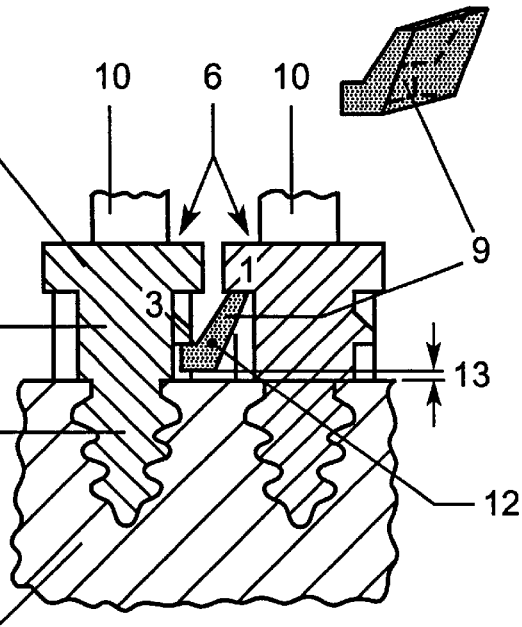
Figure 4:
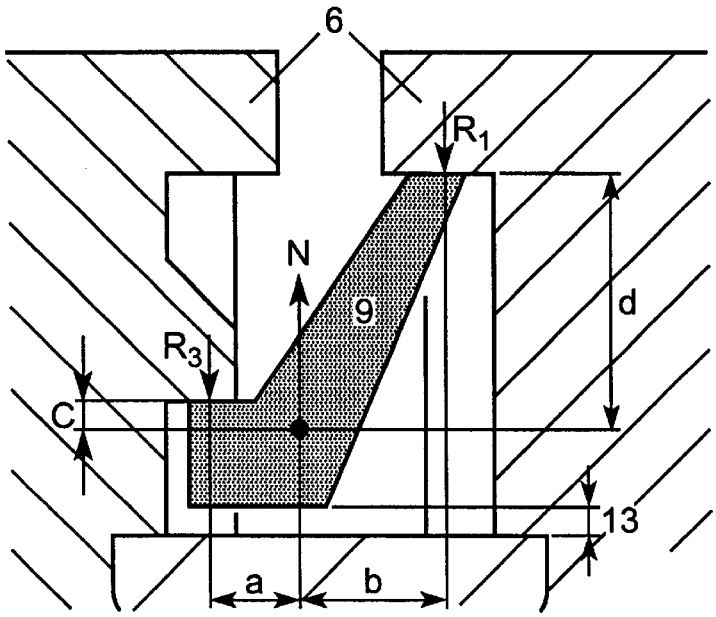
FIG. 4 shows an enlargement of a portion of FIG. 3B, illustrating in detail the damping element positioned in a blade assembly according to an embodiment of the invention.

Finally, FIGS. 3A, 3B and 4 show a further embodiment of the blade assembly according to the invention. FIGS. 3A and 3B illustrate the same cross-sectional views as those for the embodiment of FIGS. 1A and 1B. In this example, the damping element 9 has a bent shape similar to that of a golf club. This shape provides two faces on the damping element 9 which are essentially parallel to one another, a first of which faces bears against the underside of the blade platform 7 in the region 1, while a second bears against the underside of a projection on the adjacent shank 14 (contact region 3). FIGS. 3A, 3B and 4 illustrate the operating state of the blade assembly in which the damping element 9 is pressed against the faces 1 and 3 by the centrifugal force generated from rotation of the rotor 5. The damping element 9 is dimensioned in such a way that the spacing 13 from the rotor 5 and from the left-hand shank 14 is as small as possible. As a result of the center of gravity 12 being selected to be in the lower region of the damping element nearer to the contact face 3, the reactive force acting on the contact face 3 is very much greater in the event of a relative movement of the two adjacent blades 6, than the force acting on the contact face 1. As a result, oscillation of the blades at the region 1 is converted into frictional energy. For optimum damping, a frictional movement at the region 3 should be prevented or minimized. This is achieved precisely by the asymmetrical configuration of the damping element with the aim of displacing the center of gravity as close as possible to the region 3.

The reactive forces are illustrated in FIG. 4, which is an enlarged view of the damping element 9 and of the adjacent blade platforms or shanks shown in FIG. 3B. The reactive force R1 acting on the contact face 1 is significantly smaller here than the reactive force R3 acting on the contact face 3. This distribution of forces results from the position of the center of gravity 12 at which the centrifugal force N acts, in conjunction with the ratio of the dimensions a–d indicated in the figure.

In view of the illustrated embodiments, a person skilled in the art can easily derive further forms of damping elements which have the illustrated properties. The invention provides a blade damper that acts effectively in particular if adjacent blades execute only small relative movements with respect to one another. This is achieved by virtue of the fact that the damping element acts on the adjacent blades at radial positions which differ significantly from one another.

What is claimed claims:

1. A blade assembly comprising:

a rotor and a plurality of blades which are installed on the circumference of the rotor, said blades extending in a radial direction and each having a blade platform, a shank and a root; and at least one damping element, said at least one damping element being arranged between respectively adjacent blades, and being frictionally connected during rotation of the rotor to at least a first region of a first of the respectively adjacent blades and a second region of a second of the respectively adjacent blades, wherein the first region is located in the upper third of a region of the first blade which extends from the blade platform to the rotor, and the second region is located in the lower third of a region of the second blade which extends from the blade platform to the rotor.

2. The blade assembly according to claim 1, wherein the first region is located on an underside of the blade platform of the first blade, and the second region is located on the shank of the second blade.

3. The blade assembly according to claim 1, wherein the first region is located on the shank near to the blade platform of the first blade, and the second region is located on the shank of the second blade.

4. The blade assembly according to claim 1, wherein the first region is located on an underside of the blade platform of the first blade, and the second region is located on the shank of the second blade, and said at least one damping element being configured in such a way that, on rotation of the rotor, it is additionally frictionally connected to a third region on the blade platform of the second blade, which region is located opposite the first region.

5. The blade assembly according to claim 4, wherein a radial cross section of said at least one damping element has an elongate shape with a widened end region and with an asymmetry with respect to a longitudinal axis of said at least one damping element, the widened end region being wider than the distance between the adjacent blade platforms.

6. The blade assembly according to claim 1, wherein a radial cross section of said at least one damping element has an elongate shape whose length is greater than the distance between adjacent shanks of the respectively adjacent blades.

7. The blade assembly according to claim 1, wherein a radial cross section of said at least one damping element has a bent shape and said at least one damping element has opposite end regions such that during rotation of the rotor, one end region of said at least one damping element is in frictionally locking contact with an underside of the blade platform of the first blade, and the opposite end region of said at least one damping element is in frictionally locking contact with an underside of a projection formed on the shank of the second blade.

8. The blade assembly according to claim 1, wherein said at least one damping element is asymmetrically configured in such a way that its center of gravity is located close to at least one of the first region and the second region.

9. The blade assembly according to claim 1, wherein contact faces between said at least one damping element and at least one of the first region and the second region are embodied as planar faces.

10. The blade assembly according to claim 1, wherein said at least one damping element is prevented from moving perpendicularly with respect to the radial direction by guide grooves formed on at least one of the first region and the second region.

* * * * *